US005522703A

United States Patent [19]

Okamoto

[11] Patent Number: 5,522,703

[45] Date of Patent: Jun. 4, 1996

[54] PROPULSION SYSTEM SEAL FOR OUTBOARD DRIVE

[75] Inventor: Yutaka Okamoto, Shizuoka-ken, Japan

[73] Assignee: Sanshin Kogyo Kabushiki Kaisha, Shizuoka-ken, Japan

[21] Appl. No.: 329,527

[22] Filed: Oct. 26, 1994

[30] Foreign Application Priority Data

Oct. 29, 1993 [JP] Japan ..... 5-271716

[51] Int. Cl.[6] ..... F01D 5/00

[52] U.S. Cl. ..... 416/93 A

[58] Field of Search ..... 416/93 A

[56] References Cited

U.S. PATENT DOCUMENTS 537,612 4/1895 Leathers .
599,125 2/1898 Fefel .
624,674 5/1899 Painton .
938,911 11/1909 Taylor .
1,807,254 5/1931 Piano .
1,813,552 7/1931 Stechauner .
1,853,694 4/1932 Melcher .
2,058,361 10/1936 Sherwood .
2,064,195 12/1936 De Michelis .
2,347,906 5/1944 Hatcher .
2,372,247 3/1945 Billing .
2,672,115 3/1954 Conover .
2,987,031 6/1961 Odden .
2,989,022 6/1961 Lundquist .
3,279,415 10/1966 Kickhaefer ..... 416/93 A
3,478,620 11/1969 Shimanckas .
3,769,930 11/1973 Pinkerton .
4,486,181 12/1984 Cavil ..... 416/93 A
4,529,387 7/1985 Brandt .
4,540,369 9/1985 Caires .
4,619,584 10/1986 Brandt .
4,642,059 2/1987 Nohara .
4,741,670 5/1988 Brandt .
4,767,269 8/1988 Brandt .
4,790,782 12/1988 McCormick .
4,792,314 12/1988 McCormick .
4,793,773 12/1988 Kinouchi et al. .
4,795,382 1/1989 McCormick .
4,828,518 5/1989 Kouda et al. .
4,832,570 5/1989 Solia .
4,832,636 5/1989 McCormick .
4,840,136 6/1989 Brandt .
4,887,982 12/1989 Newman et al. .
4,887,983 12/1989 Bankstahl et al. .
4,897,058 1/1990 McCormick .
4,911,663 3/1990 Meier ..... 416/93 A
4,932,907 6/1990 Newman et al. .
4,946,410 8/1990 Haman ..... 416/93 A
4,963,108 10/1990 Koda et al. .
4,993,848 2/1991 John et al. .
5,009,621 4/1991 Bankstahl et al. .
5,017,168 5/1991 Ackley .
5,030,149 7/1991 Fujita .
5,186,609 2/1993 Inoue et al. .
5,230,644 7/1993 Meisenburg et al. .
5,232,386 8/1993 Gifford .
5,249,995 10/1993 Meisenburg et al. .
5,342,228 8/1994 Magee et al. .
5,344,349 9/1994 Meisenburg et al. .
5,352,141 10/1994 Shields et al. .
5,366,398 11/1994 Meisenburg et al. .
5,423,701 6/1995 Rodskier et al. ..... 416/93 A

*Primary Examiner*—John T. Kwon
*Attorney, Agent, or Firm*—Knobbe, Martens, Olson & Bear

[57] ABSTRACT

A propulsion system for a marine outboard drive includes a seal between adjacent ends of a pair of counter-rotating propellers. The seal inhibits fluid flow through a joint between the propellers, while minimizing frictional contact between the counter-rotating propellers. In at least one embodiment, the seal contacts only one of the propellers.

16 Claims, 5 Drawing Sheets

PROPULSION SYSTEM SEAL FOR OUTBOARD DRIVE

BACKGROUND OF THE INVENTION

1. Field of the Invention

The present invention relates in general to a marine propulsion system, and more particularly to a seal between components of the propulsion system of an outboard drive.

2. Description of Related Art

Many types of marine outboard drives discharge engine exhaust beneath the water level of the body of water in which the outboard drive is operated in order to silence exhaust noise. To facilitate such submerged emission of exhaust gases, exhaust systems of outboard drives commonly discharge exhaust gases to a low pressure region in the water produced by the propulsion device of the outboard drive. Discharge at this location produces an exhaust flow through the exhaust system without the presence of an undesirably high back pressure within the exhaust system. Propulsion systems conventionally include an exhaust discharge passage with an outlet positioned behind a propulsion device of the system for this purpose.

Many propulsion systems include joints or seams between one or more rotating components of the propulsion system. These joints often extend into the exhaust discharge passage. For instance, a propulsion system which includes a pair of counter-rotational propellers commonly includes an exhaust discharge passage through the center of each propeller boss. A joint usually exists between the two propellers, and extends from the exterior of the propellers into the exhaust discharge passage. As such, the exhaust discharge passage is not sealed throughout the propulsion system.

Operation of the propulsion device commonly produces elevated water pressure on the exterior side of the device. Because this exterior water pressure significantly exceeds the pressure within the exhaust discharge passage under some operating conditions, water tends to invade the exhaust discharge passage through any open joint or seam between the components of the propulsion system. The invasive water occupies space within the discharge passage and reduces the flow area through which exhaust gases can be discharged. As a result, the pressure within the exhaust system increases which consequently limits the output power produced by the engine of the outboard drive.

Under other operating conditions, the exhaust gas pressure is greater than the water pressure, and exhaust gases are admitted through the joint between the propellers. Emission of exhaust gas in this location can cause cavitations in the water about the propellers and reduce the efficiency of the propulsion system.

SUMMARY OF THE INVENTION

A need therefore exists for a propulsion system seal which controls fluid flow through joints between rotating components of a propulsion system, while allowing the components to rotation relative to each other with minimal friction.

In accordance with one aspect of the present invention, a propulsion system for an marine outboard drive includes a pair of propellers which generally rotate about a common axis adjacent to each other. The propellers together define an inner exhaust discharge passage which extends through at least a portion of each propeller. A seal is attached to one of the propellers at a location proximate to a joint formed between the adjacent propellers. The seal is configured to control fluid flow through the joint.

In accordance with another aspect of the present invention, a propulsion system for a marine outboard drive includes a pair of rotating propulsion devices which rotate adjacent to each other. A seal is disposed proximate to a joint formed between adjacent ends of the rotating propulsion devices. The seal contacts only one of the rotating propulsion devices.

In accordance with an additional aspect of the invention, a propulsion system for a marine outboard drive includes a pair of counter-rotating propellers. The propellers rotate adjacent to each other. Sealing means controls fluid flow through a joint between adjacent ends of the propellers while minimizing frictional contact between the rotating propellers.

BRIEF DESCRIPTION OF THE DRAWINGS

These and other features of the invention will now be described with reference to the drawings of a preferred embodiment which is intended to illustrate and not to limit the invention, and in which.

DETAILED DESCRIPTION OF PREFERRED EMBODIMENTS

Figure 1:
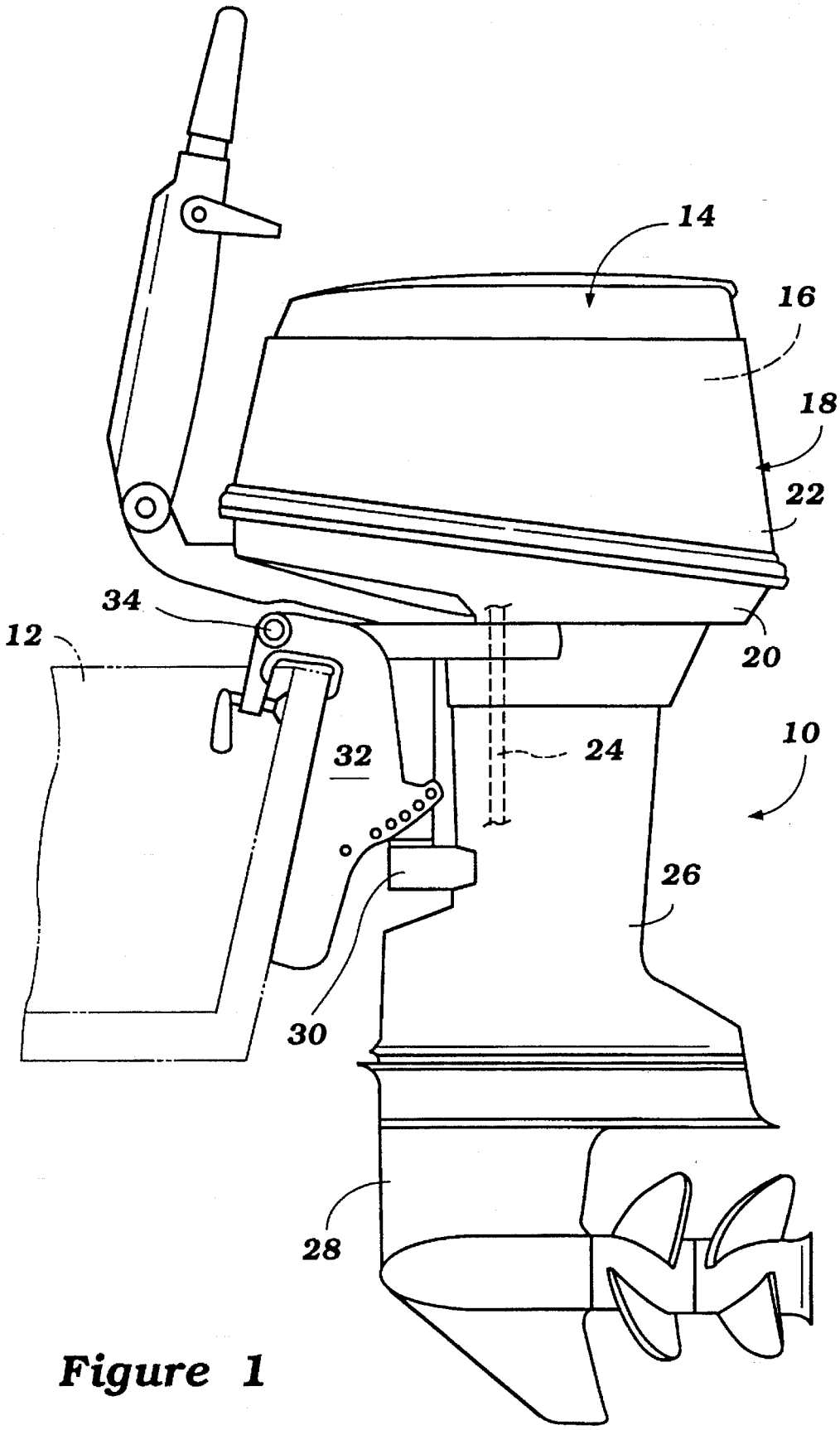
FIG. 1 is a side elevational view of a marine outboard motor configured in accordance with a preferred embodiment of the present invention.

FIG. 1 illustrates a marine outboard drive 10 configured in accordance with a preferred embodiment of the present invention. In the illustrated embodiment, the outboard drive 10 is depicted as an outboard motor for mounting on a stern of a watercraft 12. It is contemplated, however, that those skilled in the art will readily appreciate that the present invention can be applied to stern drive units of inboard-outboard motors and to other types of watercraft drive units as well.

In the illustrated embodiment, the outboard drive 10 has a power head 14 which includes an engine 16. A conventional protective cowling 18 surrounds the engine 16. The cowling 18 desirably includes a lower tray 20 and a top cowling member 22. These components 20, 22 of the protective cowling 18 together define an engine compartment which houses the engine 16.

The engine 16 is mounted conventionally with its output shaft (i.e., crankshaft) rotating about a generally vertical axis. The crankshaft (not shown) drives a drive shaft 24, as known in the art. The drive shaft 24 depends from the power head 14 of the outboard drive 10.

A drive shaft housing 26 extends downward from the lower tray 20 and terminates in a lower unit 28. As schematically illustrated in FIG. 1, the drive shaft 24 extends through and is journaled within the drive shaft housing 26.

A steering bracket 30 is attached to the drive shaft housing 26 in a known matter. The steering bracket 30 also is pivotably connected to a clamping bracket 32 by a pin 34. The clamping bracket 32, in turn, is configured to attach to a transom of the watercraft 12. This conventional coupling permits the outboard drive 10 to be pivoted relative to the steering bracket 30 for steering purposes, as well as to be pivoted relative to the pin 34 to permit adjustment to the trim position of the outboard drive 10 and for tilt up of the outboard drive 10. Although not illustrated, it is understood that a conventional hydraulic tilt and trim cylinder assembly, as well as a conventional hydraulic steering cylinder assembly could be used as well with the present outboard drive 10.

Figure 2:
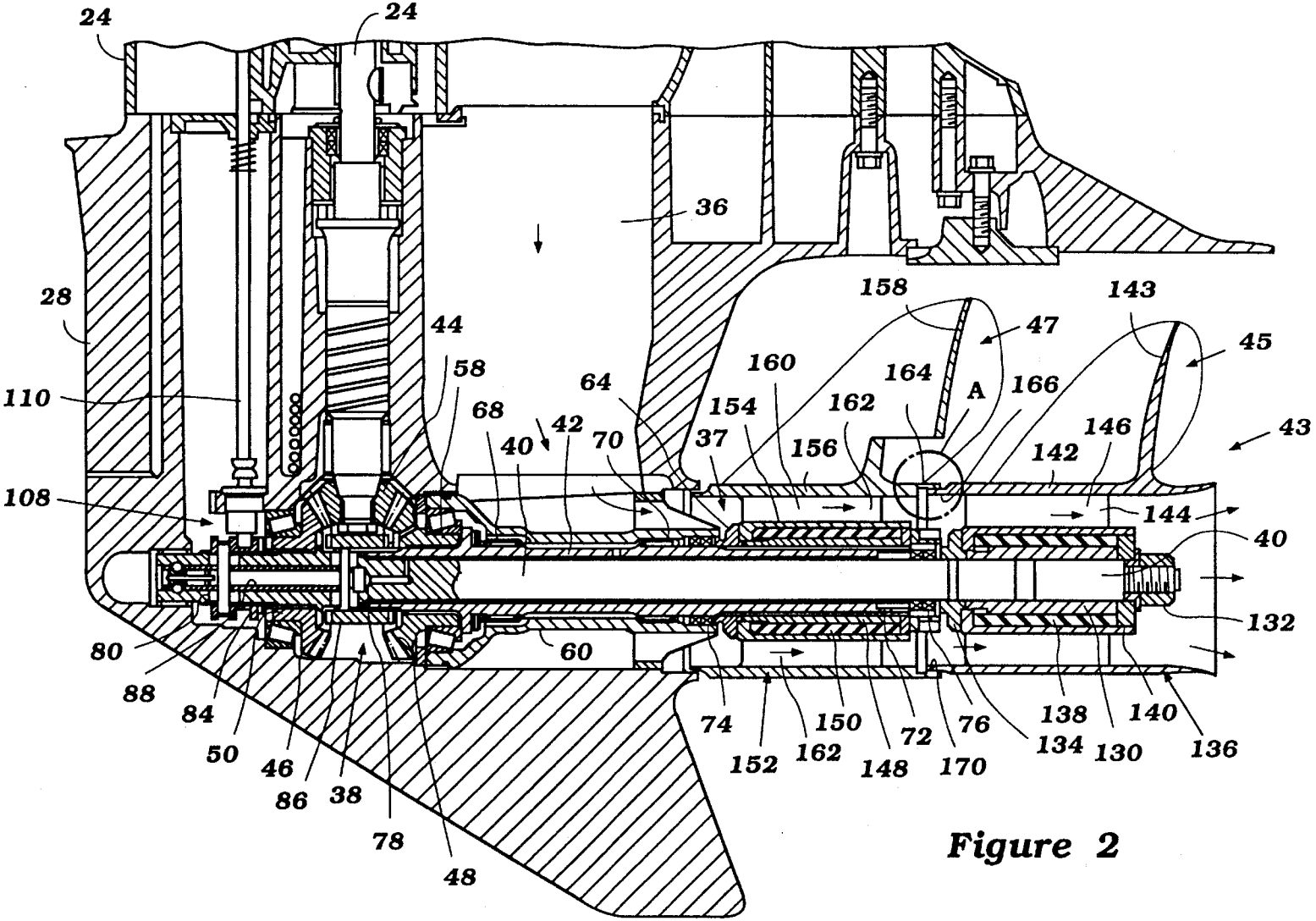
FIG. 2 is a sectional side elevational view of a lower unit of the marine outboard motor of FIG. 1.

As illustrated in FIG. 2, the drive shaft 24 extends from the drive shaft housing 26 into the lower unit 28 where a transmission 38 selectively couples the drive shaft 24 to an inner propulsion shaft 40 and to an outer propulsion shaft 42. The transmission 38 advantageously is a forward/neutral/reverse-type transmission. In this manner, the drive shaft 24 drives the inner and outer propulsion shafts 40, 42, which rotate in a first direction and in a second counter direction, respectively, as described below in detail.

The propulsion shafts 40, 42 drive a propulsion device 43, such as, for example, a propeller, a hydrodynamic jet, or the like. In the illustrated embodiment, the propulsion device 43 is a counter-rotating propeller device that includes a first propeller 45 designed to spin in one direction and to assert a forward thrust, and a second propeller 47 designed to spin in the opposite direction and to assert a forward thrust. The counter-rotational propeller device 43 will be explained in detail below.

With reference to FIG. 1, the engine 16 includes an exhaust system that discharges exhaust through an exhaust pipe (not shown). The exhaust pipe depends from the engine 16, which is positioned within the cowling 18, into an expansion chamber (not shown) formed in the drive shaft housing. As seen in FIG. 2, the drive shaft housing 26 and lower unit 28 together define an exhaust discharge duct 36 which delivers engine exhaust from the expansion chamber of the drive shaft housing 26 to an exhaust discharge passage 37 formed within the propulsion device 43, as known in the art. The outlet end of the exhaust discharge passage 37 is located behind the propulsion device 43. As noted above, the propulsion device 43 commonly produces a low pressure region or pocket, relative to the pressure within the exhaust system, as the propulsion device 43 moves the watercraft 12 through the water. By discharging the exhaust gases at this region, the low pressure region facilitates proper exhaust gas flow through the exhaust system.

Figure 3:
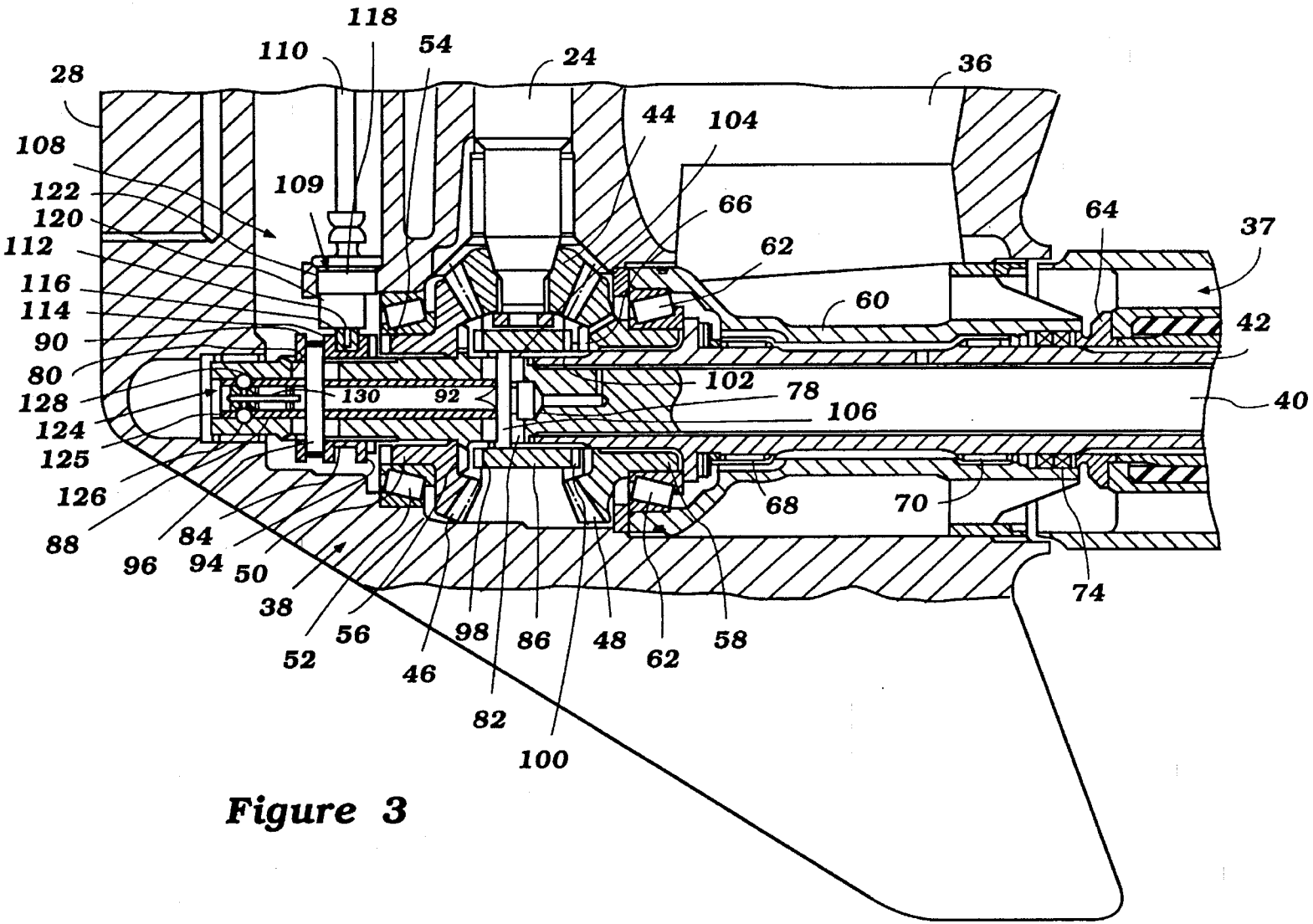
FIG. 3 is an enlarged sectional side elevational view of a transmission of the lower unit of FIG. 2.

FIG. 3 illustrates a lower portion of the drive shaft 24 and the transmission 38. The drive shaft 24 carries a drive gear 44 at its lower end, which is disposed within the lower unit 28 and which forms a portion of the transmission 38. The drive gear 44 preferably is a bevel type gear.

The transmission 38 also includes a pair of counter-rotating driven gears 46, 48, that are in mesh engagement with the drive gear 44. The pair of driven gears 46, 48 preferably are positioned on diametrically opposite sides of the drive gear 44, and are suitably journaled within the lower unit 28, as described below. Each driven gear 46, 48 is positioned at about a 90° shaft angle with the drive gear 44. That is, the propulsion shafts 40, 42 and the drive shaft 24, desirably intersect at about a 90° shaft angle; however, it is contemplated that the drive shaft 24 and the propulsion shafts 40, 42 can intersect at almost any angle.

In the illustrated embodiment, the pair of driven gears 46, 48 are a front bevel gear 46 and an opposing rear bevel gear 48. The front gear 46 includes a hub 50 which is journaled within the lower unit 28 by a front thrust bearing 52. The front thrust bearing 52 rotatably supports the front gear 46 in mesh engagement with the drive gear 44. The hub 50 has a central bore through which the inner propulsion shaft 40 passes when assembled. The inner propulsion shaft 40 is suitable journaled within the central bore of the front gear hub 50. The front gear 46 also includes a series of teeth formed on an annular front facing engagement surface 54 and on an annular rear facing engagement surface 56. The teeth on each surface 54, 56 positively engage a portion of a clutch of the transmission 36, as discussed below.

As seen in FIG. 3, the rear gear 46 also includes a hub 58 which is suitably journaled within a bearing casing 60 of the lower unit 28 by a rear thrust bearing 62. The rear thrust bearing 62 rotatably supports the rear gear 48 in mesh engagement with the drive gear 44. A front end ring 64 attached to the lower unit 28, secures the bearing casing 60 to the lower unit 28.

The hub 58 of the rear gear 48 has a central bore through which the inner propulsion shaft 40 and the outer propulsion shaft 42 pass when assembled. The rear gear 48 also includes an annular front engagement surface 66 which carries a series of teeth for positive engagement with a clutch of the transmission 38, as discussed below.

As best seen in FIG. 3, the inner propulsion shaft 40 and the hollow outer propulsion shaft 42 are disposed within the lower unit 28. The bearing casing rotatably supports the outer propulsion shaft 40. A front bearing 68 journals a front end of the outer propulsion shaft 42 within the bearing casing 60. A needle bearing 70 supports the outer propulsion shaft 42 within the bearing casing 60 at an opposite end of the bearing casing 60 from the front bearing 68.

With reference to FIG. 2, the inner propulsion shaft 40, as noted above, extends through front gear hub 50 and the rear gear hub 58, and is suitable journaled therein. On the rear side of the rear gear 48, the inner shaft 40 extends through the outer shaft 42 and is suitable journaled therein by a needle bearing 72 which supports the inner shaft 40 at the rear end of the outer shaft 42.

A first pair of seals 74 (e.g., oil seals) are interposed between the bearing casing 60 and outer propulsion shaft 42 at the rear end of the bearing casing 60. Likewise, a second pair of seals 76 (e.g., oil seals) are interposed between the inner shaft 40 and the outer shaft 42 at the rear end of the outer shaft 42. Lubricant within a lubricant sump flows through the gaps between the bearing casing 60 and the outer shaft 42, and between the outer shaft 42 and the inner shaft 40 to lubricate the bearings 68, 70, 72 supporting the inner propulsion shaft 40 and the outer propulsion shaft 42. The seals 74, 76 located at the rear ends of the bearing casing 60 and of the outer shaft 42 substantially prevent lubricant flow beyond these points.

With reference to FIG. 3, the front end of the inner propulsion shaft 40 includes a longitudinal bore 78. The bore 78 stems from the front end of the inner shaft 40 to a bottom surface which is positioned on the rear side of the axis of the drive shaft 24. A front aperture 80 extends through the inner shaft 40, transverse to the axis of the longitudinal bore 78, at a position forward of the front bevel gear 46. The inner shaft 40 also includes a rear aperture 82 that extends transverse to the axis of the longitudinal bore 78 and is generally symmetrically positioned between the front bevel gear 46 and the rear bevel gear 48.

As best seen in FIG. 3, the transmission 36 also includes a front dog clutch 84 and a rear dog clutch 86 coupled to a plunger 88. As discussed in detail below, the front dog clutch 84 selectively couples the inner propulsion shaft 40 to the front gear 46. The rear dog clutch 86 selectively couples the outer propulsion shaft 42 either to the front gear 46 or to the rear gear 48. FIG. 3 illustrates the front dog clutch 84 and the rear dog clutch 86 set in a neutral position (i.e., in a position in which the clutches 84, 86 do not engage either the front gear 46 or the rear gear 48).

The plunger 88 has a generally cylindrical rod shape and slides within the longitudinal bore 78 of the inner shaft 40 to actuate the clutches 84, 86. The plunger 88 may be solid; however, it is preferred that the plunger 88 be hollow (i.e., a cylindrical tube), especially where a neutral detent mechanism of the type described below is used.

The plunger 88 includes a front hole 90 that is positioned generally transverse to the longitudinal axis of the plunger 88, and a rear hole 90 that is likewise positioned generally transverse to the longitudinal axis of the plunger 88. Each hole 90, 92 desirably is located symmetrically in relation to the corresponding apertures 80, 82 of the inner propulsion shaft 40.

As seen in FIG. 3, the front dog clutch 84 has a generally spool-like shape and includes an axial bore which extends between an annular front end and a flat annular rear end 94. The rear end 94 of the clutch 84 extends generally transverse to the longitudinal axis of the clutch 84. The bore is sized to receive the inner propulsion shaft 40.

The rear surface 94 of the front dog clutch 84 is substantially coextensive in area with the annular front engagement surface 54 of the front gear 48. Teeth extend from the clutch rear surface 94 in the longitudinal direction and desirably correspond to the teeth of the front engagement surface 54 of the front gear 46, both in size (e.g., axial length) and in configuration.

The front dog clutch 84 includes a spline connection to the inner propulsion shaft 40. Internal splines of the front dog clutch matingly engage external splines on the external surface of the inner drive shaft 40. This spline connection provides a driving connection between the front clutch 84 and the inner propulsion shaft 40, and permits the front clutch 84 to slide over the inner propulsion shaft 40, as discussed below.

The front dog clutch 84 also includes a hole that extends through the midsection of the clutch 84 in a direction generally transverse to the longitudinal axis of the clutch 84. The hole is sized to receive a pin 96, which, when passed through the front aperture 80 of the inner propulsion shaft 40 and through front hole 90 of the plunger 88, interconnects the plunger 88 and the front dog clutch 84, with a portion of the inner shaft 40 interposed therebetween. The pin 96 may be held in place by a press-fit connection between the pin 96 and the front hole 90 of the plunger 88, or by a conventional coil spring (not shown) which is contained within a groove about the front dog clutch 84.

As also seen in FIG. 3, the rear dog clutch 86 generally has a tubular shape and includes an axial bore which extends between a flat annular front end surface 98 and a flat annular rear end surface 100. The bore is sized to receive the outer propulsion shaft 42.

The annular end plates 98, 100 of the rear clutch 86 are substantially coextensive in size with the annular engagement surfaces 56, 66 of the front and rear gears 46, 48, respectively. Teeth extend from each end surface 98, 100 of the rear clutch 86 and desirably correspond to the respective teeth of the front and rear gears 46, 48 both in size (e.g., axial length) and in configuration.

The rear dog clutch 86 has a spline connection 102 to the outer propulsion shaft 42 which establishes a drive connection between the rear clutch 86 and the shaft 42, yet permits the clutch 86 to slide along the axis of the shaft 42 between the front and rear gears 46, 48. The rear dog clutch 86 specifically includes internal splines within the bore that mate with corresponding external splines on the outer periphery of the outer propulsion shaft 42.

The rear dog clutch 86 also includes an internal annular groove 104. The internal groove 104 is sized to receive a pin 106 which extends through the rear aperture 82 of the inner propulsion shaft 40 and through the rear hole 92 of the plunger 88 when assembled. Roller bearings journal the pin 106 within the internal groove 104 of the rear dog clutch 86, as known in the art. In this manner, the rear clutch 86 is rotatably coupled to the plunger 88, while drivingly connected to the outer propeller shaft 42.

The pin 106 is inserted into the internal annular groove 104 through an aperture (not shown) in the rear dog clutch 86. When assembled, the pin 106 is passed through the aperture and is inserted between the roller bearings in the groove 104, through the rear aperture 82 of the inner propulsion shaft 40 and through the rear hole 92 of the plunger 88. The pin 106 may be held in place by a press-fit connection between the pin 106 and the plunger 88, or by other conventional means.

With reference to FIG. 2, an actuator mechanism 108 moves the plunger 88 of the clutch assembly from a position in which the front and rear dog clutches 84, 86 engage the first and second gears 46, 48, respectively, through a position of nonengagement (i.e., the neutral position), and to a position in which the rear dog clutch 86 engages the front gear 48. The actuator mechanism 108 positively reciprocates the plunger 88 between these positions. FIGS. 2 and 3 best illustrate an exemplary embodiment of the actuator mechanism.

As seen in FIG. 2, the actuator mechanism 108 includes a cam member 109 which connects the plunger 88 to a rotatable shift rod 110. In the illustrated embodiment, the shift rod 110 depends in the vertical direction through the drive shaft housing 26 and into the lower unit 28. The actuator mechanism 108 also includes a remote gear shifter, which is mounted conventionally proximate to the steering controls of the watercraft (not shown). The gear shifter includes a shift lever which is coupled to a conventional shift slider via a bowden wire cable. The shift slider connects to a lever arm, which in turn connects to one end of a link. An opposite end of the link is fixed to the shift rod 110 so as to move the cam member 109 of the actuator mechanism 108 in response to movement of the shift lever, as known in the art. In this manner, the actuator 108 controls the transmission 38.

In the illustrated embodiment, the cam member 109 converts rotational movement of the shift rod 110 into linear movement of the plunger 88 to move the plunger 88 and the clutches 84, 86 generally along the axis of the propulsion shafts 40, 42. As best seen in FIG. 3, the cam member 109 is affixed to a lower end of the shift rod 110. The cam member 109 includes an eccentrically positioned drive pin 112 which extends into an annular groove 114 that circumscribes the front clutch 84. Roller bearings 116 journal the pin 112 within the groove 114 of the front dog clutch 84. The front clutch 84 thus is coupled to the cam member 109 in a manner in which rotational movement of the cam member 109 moves the front clutch 84 linearly along the inner drive shaft 40, while permitting the clutch 84 to rotate with the inner propeller shaft 40, relative to the cam member 109.

The cam member 109 also includes a cylindrical upper bearing 118 and a smaller diameter, cylindrical lower member 120. The upper bearing 118 is positioned to rotate about the axis of the shift rod 110 and is suitable journaled within an upper bore 112 of the lower unit 28. The lower member 120 is eccentrically positioned relative to the axis of the shift rod 110 and upper bearing 118.

The present outboard drive 10 additionally may include a neutral detent mechanism 124 to hold the plunger 88 (and the coupled clutches 84, 86) in the neutral position. FIG. 3 illustrates an embodiment of a neutral detent mechanism 124 used with the hollow plunger 88 in which the detent mechanism 124 cooperates between the plunger 88 and the inner propulsion shaft 40.

The neutral detent mechanism 124 is formed in part by at least one, and preferably two transversely positioned holes 125 in the hollow plunger 88. These holes 125 receive detent balls 126. The detent balls 126 each have a diameter slightly smaller than diameter of each hole 125.

As seen in FIG. 3, the inner propulsion shaft 38 includes an annular groove 128 which is formed on the inner wall of the bore 78 through which the plunger 88 slides. The groove 128 is positioned within the bore 78 so as to properly locate the dog clutches 84, 86 in the neutral position when the detent holes 125 of the plunger 88 coincide with the axial position of the annular groove 128.

A spring plunger 130, formed in part by a helical compression spring, biases the detent balls 126 radially outward, against the inner wall of the inner propulsion shaft bore 78. The plunger 88 contains the spring plunger 130 within its bore. The spring plunger 130 forces portions of the detent balls 126 into the annular groove 128 when the plunger 88 is moved into the neutral position. This releasably connection between the detent balls 126 carried by the plunger 88 and the groove 128 of the inner propulsion shaft 40 releasably restrains movement of the plunger 88 relative to the inner propulsion shaft 40, as known in the art. Because the detent mechanism 124 is believed to be conventional, further description of the detent mechanism 124 is thought unnecessary for an understanding of the present invention.

As noted above, the propeller shafts 40, 42, when coupled to the drive shaft 24 by the transmission 38, drive the propulsion device 43. The propulsion device 43 will now be described principally in reference to FIG. 2.

As seen in FIG. 2, the inner shaft 40 extends beyond the rear end of the outer shaft 42. The rear end of the inner shaft 40 carries an engagement sleeve 130 having a spline connection with the rear end of the inner shaft 40. The sleeve 130 is fixed to the inner shaft rear end between a nut 132 threaded on the rear end of the shaft 40 and an annular retainer ring 134 that engages the inner shaft 40 proximate to the rear end of the outer shaft 42.

The inner shaft 40 also carries a first propeller boss 136. An elastic bushing 138 is interposed between the engagement sleeve 130 and the propeller boss 136 and is compressed therebetween. The bushing 138 is secured to the engagement sleeve 130 by a heat process known in the art. The frictional engagement between the boss 136, the elastic bushing 138, and the engagement sleeve 130 is sufficient to transmit rotational forces from the sleeve 130, driven by the inner propulsion shaft 40, to the first propeller 45 attached to the propeller boss 136.

The propeller boss 136 has an inner sleeve 140 and an outer sleeve 142 to which the propeller blades 143 are integrally formed. A plurality of radial ribs 144 extend between the inner sleeve 140 and the outer sleeve 142 to support the outer sleeve 142 about the inner sleeve 140 and to form a passage 146 through the propeller boss 136. Engine exhaust is discharged through the passage 146, as known in the art and as described below.

The outer shaft 42 carries the second propeller 47 in a similar fashion. As best seen in FIG. 2, the rear end portion of the outer shaft 42 carries a second engagement sleeve 148 in driving engagement thereabout by a spline connection. The second engagement sleeve 148 is secured onto the outer shaft 42 between the annular retaining ring 134 and the front end ring 64.

A second annular elastic bushing 150 surrounds the second engagement sleeve 148. The bushing 150 is secured to the sleeve 148 by heat process known in the art.

A second propeller boss 152 surrounds the elastic bushing 150, which is held under pressure between the boss 152 and the sleeve 148 in frictional engagement. The frictional engagement between the propeller boss 152 and the bushing 150 is sufficient to transmit a rotational force from the sleeve 148 to the second propeller 47 attached to the second propeller boss 152.

Similar to the first propeller boss 136, the second propeller boss 152 has an inner sleeve 154 and an outer sleeve 156. The propeller blades 158 of the second propeller 47 are integrally formed on the exterior of the outer sleeve 156. Ribs 160 interconnect the inner sleeve 154 and the outer sleeve 156 and form an axially extending passage 162 between the sleeves 154, 156 that communicates with the exhaust passage 36 in the lower unit 28 and with the exhaust passage 146 of the first propeller boss 136. In the illustrated embodiment, the passages 146, 162 of the first and second propeller bosses 136, 152 together define the exhaust discharge passage 37 which extends through the propulsion device 43.

As seen in FIG. 2, the rear end 164 of the second boss 152 and the front end 166 of the first boss 136 generally lie adjacent to each other so as to form the continuous exhaust discharge passage 37. A seal 168 (FIG. 4), located proximate to the joint 170 between the first and second bosses 136, 152, controls fluid flow through the joint 170. Under some operating conditions, the seal 168 inhibits water entry into the exhaust discharge passage 37. Under other operating conditions, the seal 168 inhibits exhaust gas flow through the joint 170. The adjacent ends 164, 166 of the first and second bosses 136, 152 also may overlap to assist the seal 168 in controlling fluid flow through the joint 170, as well as to provide a seat for the seal 168.

Figure 4:
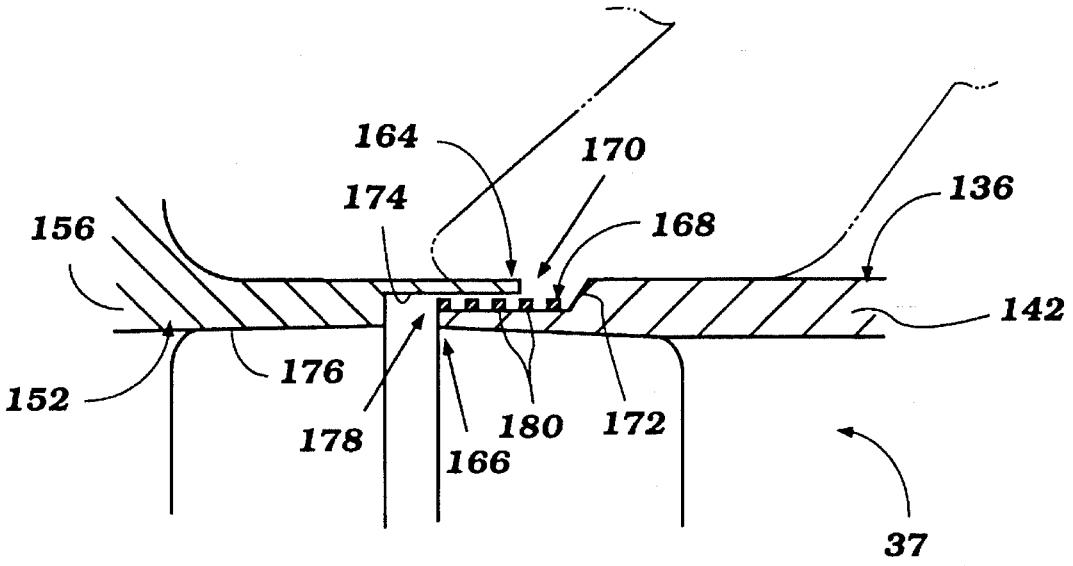
FIG. 4 is an enlarged sectional side elevational view of the area within circle A of FIG. 2, illustrating a propeller seal between propeller bosses in accordance with a preferred embodiment of the present invention.

In the illustrated embodiment, as best seen in FIG. 4, the outer sleeve 142 of the first boss 136 includes a seat 172 in the form of a step at the front end 166 on the exterior surface of the outer sleeve 142. At the seat 172, the outer sleeve 142 has a smaller outer diameter than the general outer diameter of the outer sleeve 142. The seat 172 desirably continues around the entire circumference of the outer sleeve 142.

Similarly, the outer sleeve 156 of the second boss 152 includes a relief 174 on its inner surface 176 at the rear end 164 of the second boss 152. At the relief 174, the outer sleeve 156 has a larger inner diameter than the general inner diameter of the sleeve inner surface 176. The relief 174 desirably continues around the entire inner circumference of the sleeve inner surface 176.

The cooperating seat 172 and relief 174 are sufficiently sized such that the corresponding ends 164, 166 overlap without contact between the first and second bosses 136, 152. As best seen in FIG. 4, the overlapping ends 164, 166 form a small gap 178 at the joint 170 between the two propellers 45, 47.

FIG. 4 illustrates the seal 168 which is configured in accordance with a preferred embodiment of the present invention. The seal 168 is interposed between the overlapping ends 164, 166 of the corresponding outer sleeves 142, 156 and generally fills the gap 178 formed between the ends 164, 166.

The seal 168 desirably comprises an annular ring which includes a plurality of radially projecting ribs 180 arranged to form a labyrinth-type structure. As illustrated by the other embodiments of the seal described below, other configurations and designs of the seal 168 can be used to control fluid flow through the joint 170 between the propeller bosses 136, 152. It also is understood that seal 168 may not completely surround the entire circumference of the joint 170 between the bosses 136, 152.

In the illustrated embodiment, the seal 168 sits within the seat 172 of the first boss 136 to substantially fill the gap 178. In this position, the seal 168 lies substantially close to the inner surface of the relief 174 of the second outer sleeve 156, but does not directly contact the second boss 152. In this manner, the seal 168 inhibits water and exhaust gas flow through the gap 178 while not contacting the second propeller 47, which would produce friction between the counter-rotating propellers 45, 47.

Figure 5:
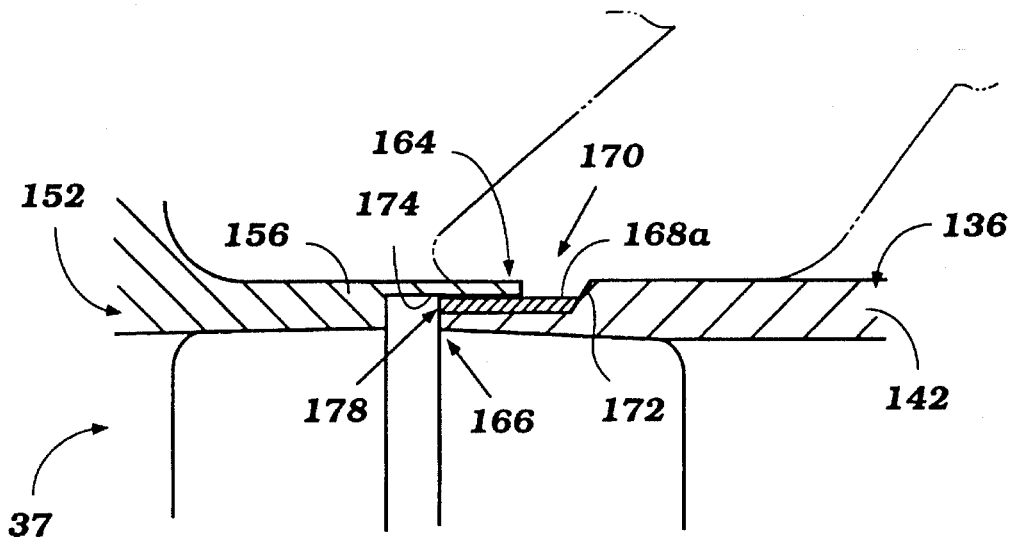
FIG. 5 is an enlarged sectional side elevational view of a propeller seal in accordance with another preferred embodiment of the present invention.

FIG. 5 illustrates another embodiment of a seal **168*a* to seal the joint 170 between the propeller bosses 136, 152. An "a" suffix is used with reference numeral "168**" to designate this embodiment of the seal.

Similar to the above-described embodiment, the seal **168*a* is interposed between the overlapping ends 164, 166 of the corresponding outer sleeves 142, 156. The seal 168*a* specifically sits within the seat 172 of the first boss 136 to fill the gap 178 formed between the ends 164, 166**.

The seal **168*a* desirably has an annular ring-like shape to fill the gap 178 around the entire circumference of the bosses 135, 152. As seen in the embodiment of FIG. 5, the seal 168*a* generally has a rectangular shape in cross section. The width of the seal 168*a* generally equals the width of the seat 172. The seal 168*a* also has a thickness that substantially equals to the gap spacing (i.e., the distance between the inner surface of the relief 174 and the outer surface of the seat 172). In this manner, the seal 168*a* lightly contacts the inner surface of the relief 174 to close the gap 178, yet minimizes the frictional forces produces from such contact between the seal 168*a* (attached to the first propeller 45) and the second boss 152 of the second propeller 47 as the propellers 45, 47** rotate in opposite directions.

The above-described seals 168, **168*a* can be formed of any of a wide variety of materials common to marine seals. Such materials are readily known and will be apparent to those skilled in the art. In the illustrated embodiment, the seals 168, 168*a* desirably are made of an elastic material which resists abrasion, such as, for example a synthetic rubber. As such, each seal 168, 168*a* can be stretched around the circumference of the seat 172 to hold the seal 168, 168*a* within the seat 172. The seal 168, 168*a* additionally or in the alternative can be bonded or otherwise attached to the outer sleeve 142 to maintain the proper position of the seal 168 between the overlapping ends 164, 166 of the propeller bosses 136, 152**.

Figure 6:
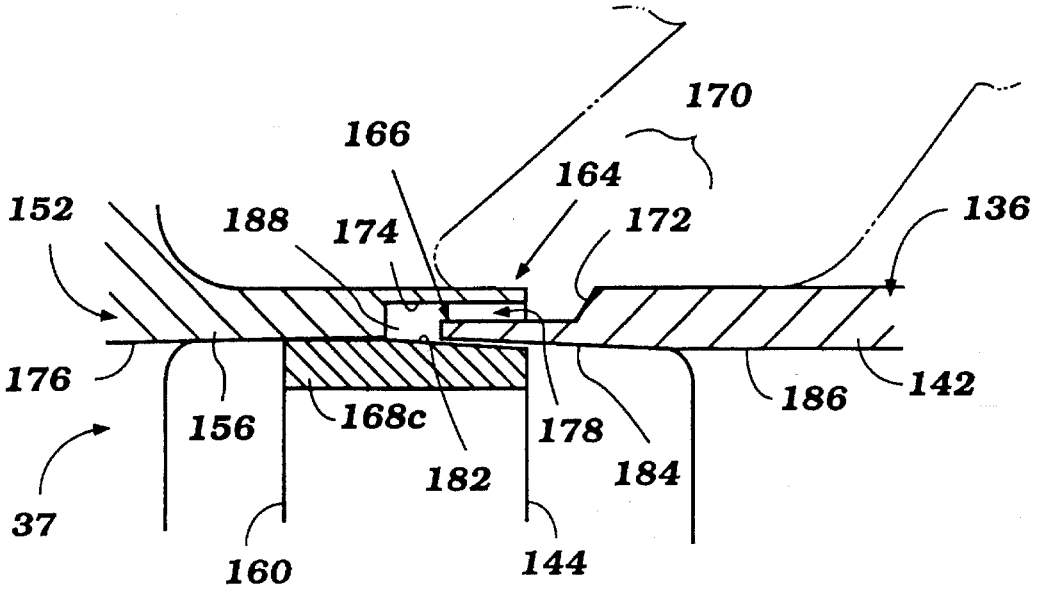
FIG. 6 is an enlarged sectional side elevational view of a propeller seal in accordance with an additional preferred embodiment of the present invention.

FIG. 6 illustrates an additional embodiment of the seal **168*c*. Reference numeral "168" with a "c" suffix is used in FIG. 6** to designated this embodiment of the seal.

As understood from FIG. 6, the seal **168*c* has an annular ring-like shape with an outer diameter that substantially matches the inner diameter of the sleeve inner surface 176. The seal 168*c* also generally has a rectangular shape in cross section. The seal 168*c* includes a chamfered rear edge 182 which cooperates with a corresponding chamfer 184 on an inner surface 186 of the front outer sleeve 142**.

As seen in FIG. 6, the seal **168*c* is positioned within the exhaust discharge passage 37 over an inner portion of the gap 178 to generally seal the gap 178 from inside the propeller bosses 136, 152. In the illustrated embodiment, the seal 168*c* contacts the inner surface 176 of the second outer sleeve 156 and cantilevers across an inner opening 188 of the gap 178 and over a portion of the inner surface 186 of the first outer sleeve 142. The seal 168*c* lies just beneath the inner surface 186 of the first outer sleeve 142, but desirably does not contact the inner surface 186 to minimize friction between the counter-rotating propellers 45, 47. Specifically, the chamfered sections 182, 184 of the annular seal 168*c* and of the circular inner surface 186 of the first outer sleeve 142 cooperate in a manner which allows the seal 168*c* to be inserted into the front end 166 of the first outer sleeve 142 without contacting the first outer sleeve 142. The corresponding shapes of the chamfered sections 182, 184 allow the seal 168*c* to extend just below the inner surface 186. The spacing between the inner surface 186 and the seal 168*c* is less than the gap spacing between the overlapping ends 164, 166 of the outer sleeves 142, 156**.

When assembled with the propellers 45, 47, the seal **168*c* is advanced within the axially passage 162 of the second boss 152 until it abuts the rear ends of the ribs 160 of the boss 152. The seal 168*c* desirably forms an interference fit with the inner surface 176 of the second boss 152 to maintain the proper position of seal 168*c*. Alternatively, the seal 168*c* can be bonded or otherwise attached to the inner surface 176 of the second outer sleeve 156. As seen in FIG. 6, the seal 168*c* lies between the ribs 144, 160 of the first and second bosses 136, 152, respectively, when these components are assembled together. It also is understood that the seal 168*c* alternatively can form an interference fit with the first outer sleeve 142 and cover a portion of the inner surface 176 of the second outer sleeve 156**, in a manner similar to that described above.

As with the previously discussed embodiments, the seal **168*c* can be formed of any material commonly to marine seals and generally known to those skilled in the art. The seal 168*c*** desirable is formed of a synthetic rubber.

The seal **168*c* in combination with the overlapping ends 164, 166 of the propeller bosses 136, 152 presents a labyrinth path through the gap 178. This labyrinth flow path, together with the tight spacing between the seal 168*c* and the inner surfaces 176, 186 of the outer sleeves 142, 156, substantially inhibits water flow through the gap 178 and into the exhaust discharge passage 37, and inhibits exhaust gas flow through the gap 178 and into the water stream through the propellers 45, 47**.

Figure 7:
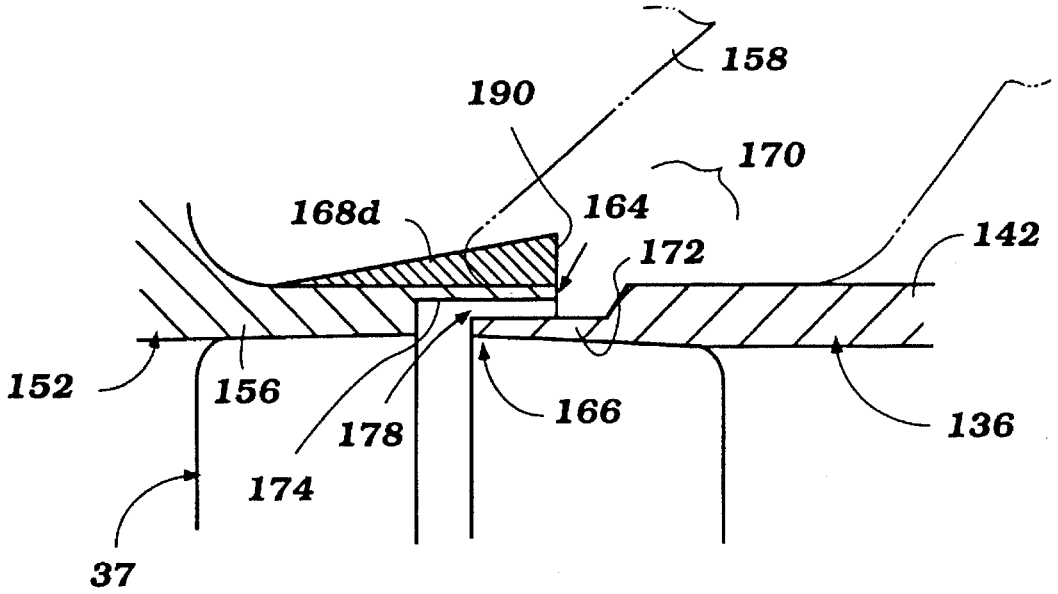
FIG. 7 is an enlarged sectional side elevational view of a propeller seal in accordance with another preferred embodiment of the present invention.

FIG. 7 illustrates an additional embodiment of the seal. In this embodiment, the seal will be designated by reference numeral "**168*d*.**"

As understood from FIG. 7, the seal **168*d* has an annular ring-like shape with an inner diameter that generally matches the outer diameter of the second outer sleeve 156. The seal 168***d* also may include reliefs (not shown) which receive a portion of the propeller blades 158 so that a section of the annular seal 168*d* extends between the blades 158. In the alternative, the seal 168*d* can be formed of a plurality of arcuate segments which lie over portion of the outer surface of the second outer sleeve 156, between the blades 158.

The seal 168*d* desirably has a shape which reduces the fluidic pressure behind the seal 168*a* when the seal is placed in a fluid stream. In the illustrated embodiment, the seal 168*d* has a cross-sectional shape which increases in thickness in the rearward direction. In particular, the seal 168*d* has a triangular shape which slopes radially outward towards the joint 170 in the rearward direction. It is understood, however, that the seal 168*d* can have other cross-sectional shapes which increase towards the joint 170 as well.

As seen in FIG. 7, the seal 168*d* circumscribes the exterior of the second outer sleeve 156 at a location proximate to and forward of the joint 170. In the illustrated embodiment, a rear end 190 of the seal 168*d* lies flush with the rear end 164 of the second outer sleeve 156. In this position, the seal 168*d* gives the second outer sleeve 156 an outer surface which rises above the outer surface of the of the first outer sleeve 142 proximate to the joint 170.

The seal 168*d* can be formed of any material commonly to marine seals which are generally known to those skilled in the art. The seal 168*d* desirable is formed of an elastic material, such as, for example, a synthetic rubber, to stretch over the exterior of the second outer sleeve 156. Alternatively, the seal 168*d* can be formed of harder material (e.g., TEFLON®) and bonded or otherwise attached to the exterior of the second propeller boss 152.

When the propellers 45, 47 produce a water flow over the joint 170, the seal 168*d* deflects the water flow radially outwardly, away from the joint 170. A low pressure region forms behind the seal 168*d* due to the associated venturi effects produced by the deflected water stream. In the illustrated embodiment, the produced low pressure region occurs at the joint 170. The water pressure within this region is substantially less than the pressure of the water flow through the propellers 43, 47 (FIG. 2).

The seal 168*d*, by producing this region of low water pressure adjacent to the joint 170, controls fluid flow through the joint 170. Under some operating conditions, a pressure differential between the fluidic pressure within the exhaust discharge passage 37 and this region of low water pressure is less than the pressure differential between the water pressure of the water stream flowing through the propellers 45, 47 and the fluidic pressure within the exhaust discharge passage 37. Under these conditions, the seal 168*d* reduces the tendency of the water to flow through the joint. Under other operating conditions, the water pressure within the region behind the seal 168*d* is generally equal to the fluidic pressure within the exhaust discharge passage, and the water surrounding the joint 170 tends not to flow through the gap 178 and into the exhaust discharge passage 37. Under both of these operating conditions, the seal inhibits water flow through the joint 170 and into the passage 37. At increased volumes of exhaust output, the fluidic pressure within the discharge passage 37 may be higher than the pressure within the low pressure region behind the seal 168*d*. Thus, unlike the other embodiments, the present seal 168*d* promotes exhaust discharge through the gap 178 and into the water stream. In this manner, under all operating conditions, the seal 168 controls, either by promoting or inhibiting, fluid (e.g., exhaust gas or water) flow through the joint 170.

In operation, each of the seals described above controls fluid flow through the joint 170, while minimizing frictional contact between the rotating propellers 45, 47. As noted previously, the propellers 45, 47 when spinning increase the water pressure on the exterior of the joint 170 between the propellers bosses 136, 152. As such, a large pressure drop occurs across the joint 170 under some operating conditions. The seal inhibits the pressurized water from entering the exhaust discharge passage 37. The seal, however, does not produce any meaningful friction between the propellers 45, 47. In several of the above embodiments, the seal contacts only one of the spinning propellers 45, 47. Under the operating conditions where an elevated fluidic pressure is produced in the exhaust discharge passage 37, the seal controls the flow of exhaust gases through the joint 170. The seal either promotes or inhibits the flow of exhaust gases through the joint 170, depending upon the particular configuration of the seal.

It is understood that the present seals could be used with a variety of outboard drives in addition to the one described above. For instance, the present propulsion system seal could be employed with the propulsion system described in U.S. patent application tilted "Propulsion System For Marine Vessel", Ser. No. 08/318,056, filed Oct. 4, 1994, in the names of Takashi Iwashita, Yasushi Iriono, Yoshitugu Sumion and Hiroshi Harada, and assigned to the assignee hereof.

Although this invention has been described in terms of a certain preferred embodiment, other embodiments apparent to those of ordinary skill in the art also are within the scope of this invention. Accordingly, the scope of the invention is intended to be defined only by the claims which follow.

What is claimed is:

1. A propeller system for a marine outboard drive comprising a pair of counter-rotating propellers which are supported at the end of at least one propeller shaft that extends from a lower unit of the outboard drive, said propellers rotating about a common axis adjacent to each other, each propeller including a hub from which at least one propeller blade extends, adjacent ends of said propeller hubs overlapping in a direction along said common axis, said propellers together defining an inner exhaust discharge passage within said hubs which extends through at least a portion of each propeller, and a seal contacting at least one of said propeller hubs at a position between said overlapping ends of said propeller hubs.

2. The propeller system of claim 1, wherein a first end of said adjacent ends lies inside a second end of said adjacent ends.

3. The propeller system of claim 2, wherein said seal is attached to said first end.

4. The propeller system of claim 3, wherein said seal contacts only said first end.

5. The propeller system of claim 3, wherein said seal contacts both said first end and said second end.

6. The propeller system of claim 2, wherein said seal is arranged so as to form a labyrinth pass extending from the exterior of said propellers, through said joint, and into said exhaust discharge passage.

7. The propulsion system of claim 1, wherein said seal generally has a labyrinth configuration.

8. A propulsion system for a marine outboard drive comprising a pair of counter-rotating propulsion devices which are arranged in series adjacent to each other and which rotate about a common axis, each propulsion device including a hub from which at least one propeller blade extends, adjacent ends of said hubs defining a gap which communicates with an internal passage defined within said hubs, and a seal attached to an inner surface of one of said hubs within said internal passage and positioned to overlie at least a portion of said gap.

9. The propulsion system of claim 8, wherein the adjacent ends of the hubs overlap in a direction along said common axis with an end of a first hub lying within an end of a second hub, said seal being attached to the inner surface of said second hub.

10. The propulsion system of claim 9, wherein said seal extends inside a portion of said first hub.

11. The propulsion system of claim 10, wherein said seal is spaced from an inner surface of said first hub by a distance which is less than the width of said gap.

12. A marine outboard drive comprising a lower unit, a pair of coaxial propulsion shafts which project from said lower unit and which generally rotate about a common axis, a pair of counter-rotating propellers positioned adjacent to each other, each propeller including an outer hub from which at least one propeller blade projects, each propeller being supported at an end of one of said propulsion shafts distanced from said lower unit with said propeller hubs being arranged in series, said adjacent ends of said propellers forming a gap, and sealing means for inhibiting fluid flow through the gap between said adjacent ends of said propellers while minimizing frictional contact between said rotating propellers.

13. The outboard drive of claim 12, wherein said sealing means comprises a seal disposed between overlapping ends of said counter-rotating propellers.

14. The outboard drive of claim 13, wherein said seal contacts only one of said overlapping ends of said counter-rotating propellers.

15. The outboard drive of claim 12, wherein sealing means comprises a seal which is disposed within said propeller hubs and extends across at least a portion of said gap, said seal being attached to an inner surface of one of said propeller hubs.

16. The outboard drive of claim 15, wherein said seal covers a portion of an inner surface of the other propeller hub.

* * * * *